United States Patent [19]

Martin et al.

[11] 4,160,246

[45] Jul. 3, 1979

[54] WIRELESS MULTI-HEAD SMOKE DETECTOR SYSTEM

[75] Inventors: Stephen M. Martin, Pleasanton; Ralph P. Miller, Sunnyvale, both of Calif.

[73] Assignee: Fairchild Camera and Instrument Corp., Mountain View, Calif.

[21] Appl. No.: 839,074

[22] Filed: Oct. 3, 1977

[51] Int. Cl.[2] ..... G08B 17/10

[52] U.S. Cl. ..... 340/630; 250/574; 356/340; 340/539; 340/636; 356/438

[58] Field of Search ..... 340/237 S, 249, 224, 340/420, 421, 630, 636, 539; 356/207; 250/574, 575

[56] References Cited

U.S. PATENT DOCUMENTS

| | | | |
|---|---|---|---|
| 3,852,740 | 12/1974 | Haymes | 340/420 X |
| 3,946,241 | 3/1976 | Malinowski | 340/237.5 X |
| 3,967,258 | 6/1976 | Bucy, Jr. | 340/249 X |
| 4,063,410 | 12/1977 | Welling | 340/224 X |

*Primary Examiner*—John W. Caldwell, Sr.
*Assistant Examiner*—Daniel Myer
*Attorney, Agent, or Firm*—Alan H. MacPherson; Robert C. Colwell; Ronald J. Meetin

[57] ABSTRACT

A wireless smoke detector apparatus including at least one detector/transmitter unit and a receiver/annunciator unit. The detector/transmitter having a pulsed infrared radiation source, a photodetector having an optical axis angularly intersecting the axis of the radiation source for detecting radiation scattered by smoke particles and a transmitter responsive to the output of the detector for transmitting a unique receiver/annunciator actuating signal which is distinguishable by the receiver/annunciator from other actuating signals.

9 Claims, 4 Drawing Figures

WIRELESS MULTI-HEAD SMOKE DETECTOR SYSTEM

BACKGROUND OF THE INVENTION

1. Field of the Invention

The present invention is generally directed toward condition detection and alarm apparatus, and more particularly, toward a wireless multiple remote detector smoke detection system for monitoring smoke conditions at a plurality of locations and transmitting detected signals to a remote receiver and annunciator device.

2. Description of the Prior Art

Heretofore, numerous types of smoke detecting devices have been provided, such devices typically being battery powered or wall-plug powered units designed to sound an alarm at the site of the detected smoke conditions.

In order to connect a plurality of the prior art devices together to provide a central indication of the location of the condition sensed so as to enable the provision of specific warning to all areas or to enable steps to be taken to abate the sensed condition it was necessary to physically interconnect an annunciator panel with each of the remote devices. This, of course, resulted in substantial expense and frequently, in the case of previously built structures, required the use of unsightly wiring along floors, walls or ceilings. Moreover, because each detection device typically generated sound at the detected location, the prior art devices were heavy consumers of electrical power and were often unreliable and expensive.

Such devices however provide no warning to those out of earshot of the alarm. This obviously creates a substantial hazard to those in the same building or other structure who are not informed of the dangerous condition.

SUMMARY OF THE PRESENT INVENTION

It is therefore a primary object of the present invention to provide a novel wireless multi-source smoke condition detection system having low power consumption and a high degree of reliability.

Another object of the present invention is to provide a system of the type described which is relatively inexpensive to the consumer yet highly reliable in operation.

Still another object of the present invention is to provide a smoke detection system of the type described which may include any desired number of smoke detector units deployed so as to effectively communicate with a centrally located annunciator device.

Briefly, a preferred embodiment of the present invention includes one or more smoke detection/transmitter units and a receiver/annunciator unit capable of receiving signals from the smoke detection/transmitter units. The smoke detector/transmitter unit includes an infrared source, a photodetector angularly displaced relative to the source for detecting infrared radiation reflected or scattered by smoke particles, a transmitter responsive to the output of the detector for transmitting a particular signal when such particles are detected, means for monitoring the condition of an energizing battery and for turning on the transmitter when the battery condition falls below a predetermined mimimum level, and a clock for controlling operation of the device. The receiver/annunciator portion of the system includes a mixer-/amplifier for receiving a transmitted signal, an audio detector for detecting the transmitted signal, and annunciator means for indicating which of the detecting units has been actuated by a smoke condition.

Among the numerous advantages of the present invention is that it provides a relatively low cost, highly reliable smoke and/or other condition detection system capable of monitoring conditions at a plurality of remote sites and indicating at a central location the conditions at those sites.

Another advantage of the present invention is that it provides detector/transmitter devices which are self-powered and capable of indicating when their power supply is in a critically low condition.

These and other objects and advantages of the present invention will no doubt become apparent to those skilled in the art after having read the following detailed disclosure of a preferred embodiment which is illustrated in the several figures of the drawing.

IN THE DRAWING

DETAILED DESCRIPTION OF THE PREFERRED EMBODIMENT

Figure 1:
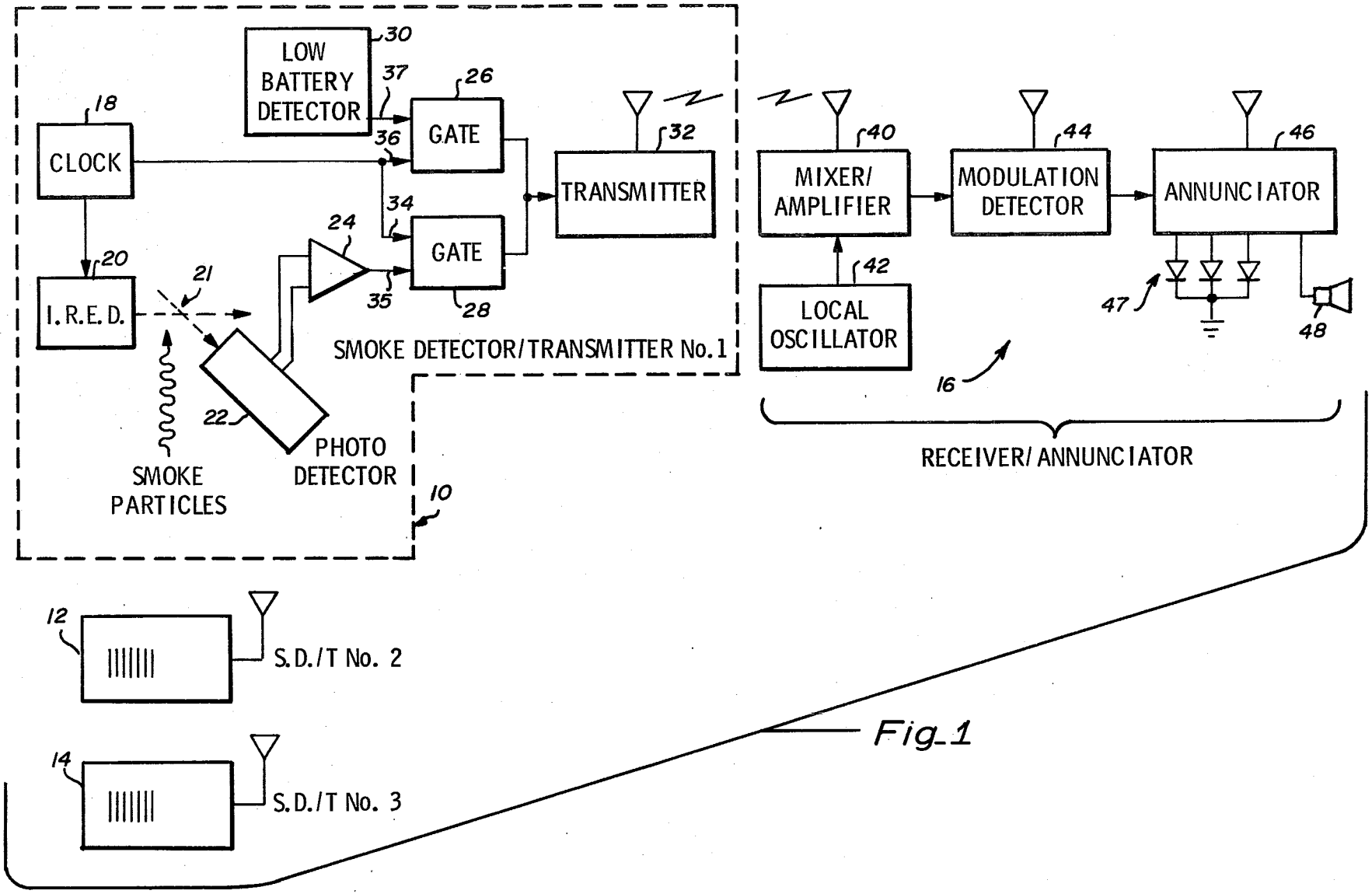
FIG. 1 is a block diagram illustrating a wireless multi-source smoke detector system in accordance with the present invention.

Referring now to FIG. 1 of the drawing, there is shown a block diagram of a multiple detection unit smoke detector and annunciator system in accordance with the present invention including three smoke detector/transmitter units, 10, 12, and 14, and a single receiver/annunciator unit 16. As indicated at 10, each remote unit 10 includes a clock signal generator 18, an infrared emission device (IRED) 20, a photodetector 22, an amplifier 24, a pair of gates 26 and 28, a low battery detector circuit 30 and a transmitter 32. Each unit also includes a suitable powering source not shown.

In the preferred embodiment, clock 18 is comprised of a circuit for generating 200-microsecond pulses at 5 to 10 second intervals which is used to repetitively energize IRED 20 and to reset gates 26 and 28. IRED 20 and photodetector 22 are arranged to have their respective emission and collection axes intersecting each other at an angle of approximately $125° \pm 10°$ so that in the absence of particulate matter in the region 21 of axes intersection no radiation from device 20 will be received by detector 22. But if particulate matter should appear at intersection 21, radiation reflected, dispersed, or refracted therefrom will be received by detector 22. The output of detector 22 is amplified by a suitable fast-response time amplifier operated in a DC mode, and the amplified output is input to the input 35 of gate 28. The clock signal generated by clock 18 is coupled into the other input 34 of gate 28.

Low battery detector 30 is a low power consumption device which generates no output so long as the charge of the powering battery remains above a predetermined threshold level. However, when the battery charge falls below such level, it will generate an output which is coupled into the input 37 of gate 26.

Gates 25 and 28 are latching devices which continuously develop voltages at their output terminals so long as a signal appears at their latching inputs 35 and 37 at the time a clock pulse is input at 34 and 36. In the event that no voltage appears on one of the inputs 35 or 37 at the time that a clock pulse appears on lines 34 and 36, the unenergized gate will be reset by the clock signal, and no voltage will be developed at its output terminal for input to transmitter 32.

In the preferred embodiment, transmitter 32 is a frequency modulating device operated at 300 megahertz with an audio superaudio, or pulsed modulation applied thereto. Preferably, the transmission carrier frequency is selected so as not to interfere with any other transmission expected in the immediate vicinity of the device. The modulation applied by each remote source has a frequency or other characteristic which is unique to itself in the system so as to enable the receiver to identify the particular sending unit.

The smoke detector/transmitter devices 12 and 14 are identical to that shown at 10 but are placed at other remote locations relative to the receiver/annunciator 16 and have other modulation frequencies.

Receiver/annunciator 16, as illustrated, is comprised of a single conversion heterodyne receiver including a mixer/amplifier 40, a local oscillator 42, a modulation detector 44, an annunciator 46 including a plurality of light-emitting diode (LED) indicators 47 and a horn or buzzer 48. The frequency of local oscillator 42 is selected so as to enable mixer 40 to demodulate the received signals and input the demodulated signal to detector 44 which then detects and filters the modulation frequency to identify the respective detector transmitting the signal. When a particular signal is detected, the appropriate indicator 47 will be actuated as will a suitable horn, bell, or other sonic indicating means 48.

Figure 2:
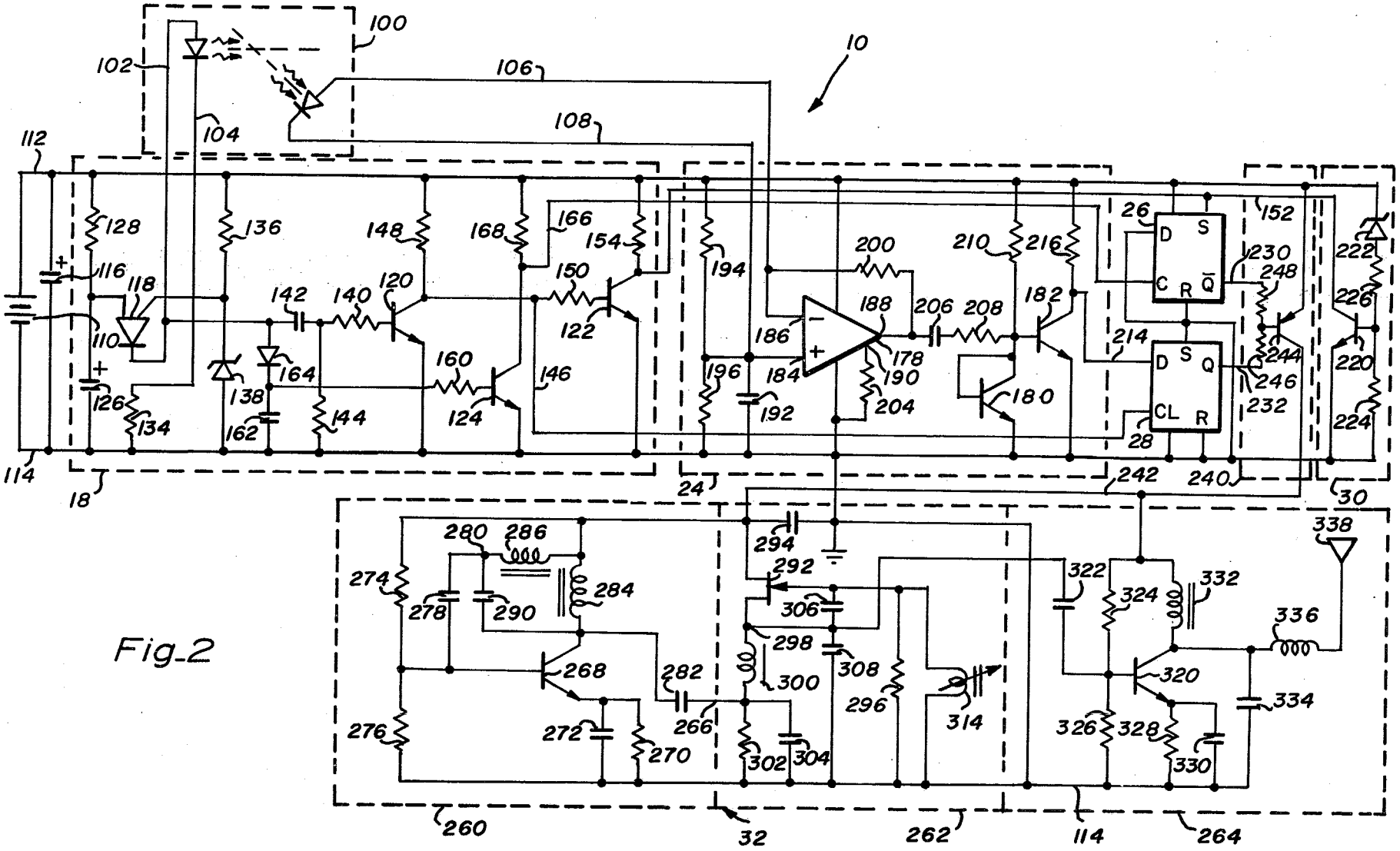
FIG. 2 is a schematic diagram illustrating the electrical components of a smoke detector/transmitter of the type shown in FIG. 1.

Turning to FIG. 2 of the drawing, a schematic diagram is shown further illustrating one of the smoke detector/transmitter units 10. Located in a smoke chamber 100, IRED 20 has an anode connected to a line 102 and a cathode connected to a line 104, and photodetector 22 is connected between a line 106 and a line 108. In this preferred embodiment, IRED 20 is a device such as that designated by product member FPE 520 and made by Fairchild Camera and Instrument Corporation, and detector 22 is a photovoltic cell such as that designated by product number VTS3085 and made by Vactec, Inc.

The unit is powered by a nine-volt battery 110, which is connected between a first power supply line 112 and a second power supply line 114. Also connected between the power supply lines 112 and 114 is a filter capacitor 116 which provides a low impedance path for AC signals, thereby reducing noise developed on the power supply lines 112 and 114 and extending the useful life of battery 110.

Clock 18 includes as active components a programmable unijunction transistor (PUT) 118 and three transistors 120, 122 and 124. PUT 118 has first input connected to power supply line 114 by an energy storage capacitor 126 and to power supply line 112 by a charging resistor 128. PUT 118 has an output connected by line 102 to the anode of IRED 20, the cathode of which is connected by line 104 and a resistor 134 to power supply line 114. PUT 118 also has a programming input for receiving a reference voltage developed at the juncture of a voltage divider comprised of a resistor 136 and a low current zener diode 138 connected between lines 112 and 114. In the preferred embodiment PUT 118 is a device such as that designated by product number MPU-1/32 and made by Motorolo, Inc.

A current flowing through resistor 128, over a period of from five to ten seconds, charges capacitor 126 to a potential one diode drop from that developed at the juncture of resistor 136 and zener diode 138. At this time PUT 118 conducts, connecting the potential developed across capacitor 126 across the series combination of IRED 20 and resistor 134. For approximately 200 microseconds, an infrared-generating current is caused to flow through IRED 20 which current is limited in part by resistor 135. The current flowing through IRED 20 and resistor 134 during this time develops a first clocking pulse on line 102.

Transistor 120 has a base connected by the series connection of a resistor 140 and a capacitor 142 to line 102 for receiving the first clocking pulse and connected to line 114 by the series connection of resistor 140 and a resistor 144 for developing a biasing potential at the base of transistor 120. The emitter of transistor 120 is connected to line 114, and the collector of transistor 120 is connected to a line 146 and through a resistor 148 to line 112. Transistor 122 has an emitter connected to line 114, a base connected by a resistor 150 to the collector of transistor 120, and a collector which is connected to a line 152 and by a resistor 154 to line 112.

Absent a pulse developed on line 102, transistor 120 is turned off by resistors 140 and 144 to develop a high logic level on line 146. The current flowing through resistors 148 and 150 turns transistor 122 on which provides a sink for current flowing through resistor 154 and generates a low logic level signal on line 152.

During the time the first clocking pulse is developed on line 102, the current flowing through capacitor 142, through resistor 140, and into the base of transistor 120 turns transistor 120 on which provides a sink for current flowing through resistor 148 and develops a low logic level on line 146. The low logic level developed on line 146 turns transistor 122 off so that it no longer provides a sink for current flowing through resistor 154. Absent a second sink for the current flowing through resistor 154, a high logic level is then developed on line 152.

Transistor 124 has an emitter which is connected to line 114 and a base which is connected to line 114 by the series connection of a current limiting resistor 160 and a capacitor 162 and which is also connected to line 102 by the series connection of resistor 160 and a diode 164. The collector of transistor 124 is connected to a line 166 and to line 112 by a resistor 168.

Absent a pulse generated on line 102, capacitor 162 and resistor 160 bias transistor 124 off, permitting resistor 168 to develop a high logic level on line 166.

Coincident with the leading edge of a first clock pulse developed on line 102, a charging current flows through diode 164 and charges capacitor 162 to a voltage one diode drop lower in potential than the clocking pulse. The voltage developed across capacitor 162 turns transistor 124 on providing a sink for current flowing through resistor 168 and developing a low logic level signal on line 166. Following the pulse developed on line 102, capacitor 162, which is now isolated from line 102 by diode 164, continues to bias transistor 124 on for several milliseconds following the pulse developed on 102.

Amplifier 24 includes an operation amplifier 178 and two transistors 180 and 182. Operational amplifier 178 has a noninverting input 184, an inverting input 186, an output 188 and a programming input 190. Operational amplifier 178 also has first and second power supply terminals connected to lines 112 and 114, respectively. The noninverting input 184 of operational amplifier is connected by line 108 to one side of photodetector 22. Noninverting input 184 is also connected to line 114 by an AC bypass capacitor 192 and to the juncture of two resistors 194 and 196 connected between lines 112 and 114, respectively, for receiving a biasing potential to bias operational amplifier 178 in the active region.

The inverting input 186 of operational amplifier 178 is connected by line 106 to the second side of detector 22 and by a resistor 200 to the output terminal 188 of operational amplifier 178. Resistor 200 is effective to partially set the gain of operational amplifier 178. A resistor 204 connected between the programming input 190 and line 114 further sets the operational amplifier's operating current. In the preferred embodiment, operational amplifier 178 is a device such as that designated by product number F776TC and made by Fairchild Camera and Instrument Corporation.

The output terminal 188 of operational amplifier 178 is AC coupled by a series combination of a capacitor 206 and resistor 208 to the base of transistor 182. The base of transistor 182 is connected to the juncture of a resistor 210 and transistor 180 connected between lines 112 and 114 for receiving a bias potential. Resistor 210 and transistor 180 develop a potential which, although biasing transistor 182 nearly off, biases it in its active region. The emitter of transistor 182 is connected to line 114 and the collector of transistor 182 is connected to a line 214 and by a resistor 216 to line 112.

The potential developed between lines 106 and 108 by detector 22 is amplified by operational amplifier 178 to develop an amplified potential at the output terminal 188. Should a pulse of infrared energy strike detector 22, such as might be generated by IRED 20 and reflected from smoke particles, detector 22 will generate a pulse on line 108 with respect to line 106. This pulse will be amplified by operational amplifier 178 resulting in a positive-going pulse at output terminal 188. The positive-going pulse will be coupled by capacitor 206 to transistor 182 which, in response, provides a sink for current flowing in resistor 216 developing an inverted logic level pulse on line 214.

Skipping next to low battery voltage detector 30, detector 30 includes a transistor 220 and a zener diode 222. Transistor 220 has a collector which is connected to line 152, an emitter which is connected to line 114, and a base which is connected by a resistor 224 to line 114 and by the series combination of a resistor 226 and zener diode 222 to line 112.

When battery 110 is developing a sufficient operating potential between lines 112 and 114, a potential equal to the difference between this value and the zener voltage will be developed across resistor 226 and resistor 224. This potential will turn transistor 220 on developing a low logic level signal on line 152. When the battery voltage decreases to a point where it develops an unsatisfactory potential between lines 112 and 114, the difference between this potential and the zener diode voltage drop will be insufficient to maintain transistor 220 in the active region, which will then allow the potential developed on line 152 to float. Transistor 220 no longer sinks current.

In the preferred embodiment, gates 26 and 28 are complementary metal-oxide semiconductor (CMOS) type D flip-flops such as those designated by product number 4013 and made by Fairchild Camera and Instrument Corporation. Gate 26 has a set input connected to line 152, a data input connected to line 114, a clock input connected to line 166, and a reset input connected to line 114, and generates a complementary output on a line 230.

Responsive to a high logic level generated on line 152, gate 26 generates a low logic level on line 230 until reset by the low-to-high transition of a logic level signal generated on line 166.

Gate 28 has a set input connected to line 114, a data input connected to line 214, a clock input connected to line 146, and a reset input connected to line 114, and generates an output on a line 232.

Following the low-to-high transition of a logic level clocking pulse generated on line 146, gate 28 generates on line 232 the logic level which was generated on line 214 coincident with the clock transition.

A transmitter driver 240 effectively connects line 112 to a line 242 to actuate transmitter 32 in response to a low logic level signal generated on line 230 or line 232. The driver includes a transistor 244 having an emitter connected to line 112, a base connected to line 232 by a resistor 246 and connected to line 230 by a resistor 248, and a collector which is connected to line 242. When high signal levels are generated on both lines 230 and 232, transistor 244 is biased off, in which state it prevents the flow of current from line 112 to line 242.

A low signal level generated on either, or both, of lines 230 and 232 causes a base current to flow into transistor 244 which saturates the device. The transistor then effectively connects line 242 to line 112 powering transmitter 32.

Transmitter 32 includes a modulation oscillator 260, a radio frequency (RF) oscillator 262 and an RF amplifier 264. Modulation oscillator 260 is connected in a common-emitter Hartley-type configuration which, when powered by an operating potential developed between lines 112 and line 242, generates on a line 266 a sine wave signal having a frequency near 100 kilohertz.

The modulation oscillator includes an NPN transistor 268 having an emitter which is connected both by an emitter biasing resistor 270 and by an AC bypass capacitor 272 to line 114. The base of transistor 268 is connected by a first biasing resistor 274 to line 242, by a second biasing resistor 276 to line 114, and by an AC coupling capacitor 278 to a node 280. The collector of transistor 268 is connected to a tank circuit and by an AC coupling capacitor 282 to line 266. This tank circuit includes a first inductor 284 connected between the collector of transistor 268 and line 242, a second inductor 286 connected between line 242 and node 280, and a capacitor 290 connected between node 280 and the collector of transistor 268.

At the frequency of oscillation the tank circuit couples energy of the proper phase and amplitude from the collector of transistor 268 to node 280 and thus to the base of transistor 268 to sustain oscillation.

The sine wave signal developed at the collector of transistor 268 is capacitively coupled by capacitor 282 to line 266.

RF oscillator 262 includes a junction field-effect transistor (J-FET) 292 which with other circuit elements is connected in a common drain, Colpitts-type oscillator configuration. Specifically, J-FET 292 has a drain which is connected to line 242 and to circuit ground (line 114) by a bypass capacitor 294 located in close proximity to J-FET 292. J-FET 292 also has a gate which is connected to an RF tank circuit and by a biasing resistor 296 to line 114 and a source which is connected to a node 298. Node 298 is connected by a radio frequency choke (RFC) 300 to line 266 for isolating RF energy developed at node 298 from oscillator 260. Line 266 is connected to line 114 by a biasing resistor 302 and a bypass capacitor 304.

The RF tank circuit includes a capacitive divider which is comprised of a capacitor 306 connected between the gate and source of J-FET 292 and a capacitor 308 connected between the source and line 114 for developing a source-to-gate feedback signal.

The RF tank circuit also includes a variable inductor 314 connected between the gate of J-FET 292 and line 114 for adjusting the frequency of oscillation.

When an operating potential is developed between line 114 and line 242, RF oscillator 262 generates a radio frequency signal. The signal developed across the RF tank circuit is coupled to the gate of J-FET 292 which generates in the source circuit an amplified signal. The amplified signal drives the RF tank circuit at the proper phase to sustain oscillations at the frequency to which the RF tank circuit is tuned. The RF tank circuit is tuned by means of inductor 314 over a range of from 220 to 350 megahertz in the preferred embodiment. Inductor 314 acts as an antenna radiating the RF signal which is modulated by the sine wave signal developed on line 266 by modulation oscillator 260.

Optional RF amplifier 264 may be used to extend the operating range of the system. Amplifier 264 includes an NPN transistor 320 connected in a common-emitter configuration. Transistor 320 has a base which is connected by an RF coupling capacitor 322 to node 298 for receiving the modulated RF signal and to the juncture of two biasing resistors 324 and 326 connected between lines 242 and 114. The transistor also has an emitter which is connected by both a biasing resistor 328 and a bypass capacitor 330 to line 114 and a collector which is connected to a parallel tuned circuit comprised of an inductor 332 connected to line 242 and a capacitor 334 connected to line 114.

A portion of the amplified RF energy developed at the collector of transistor 320 is connected by an inductor 336 to an antenna 338. In the preferred embodiment antenna 338 is a quarter wave monopole having a length of approximately 12 inches which is disposed within the housing of detector/transmitter 10.

Figure 3:
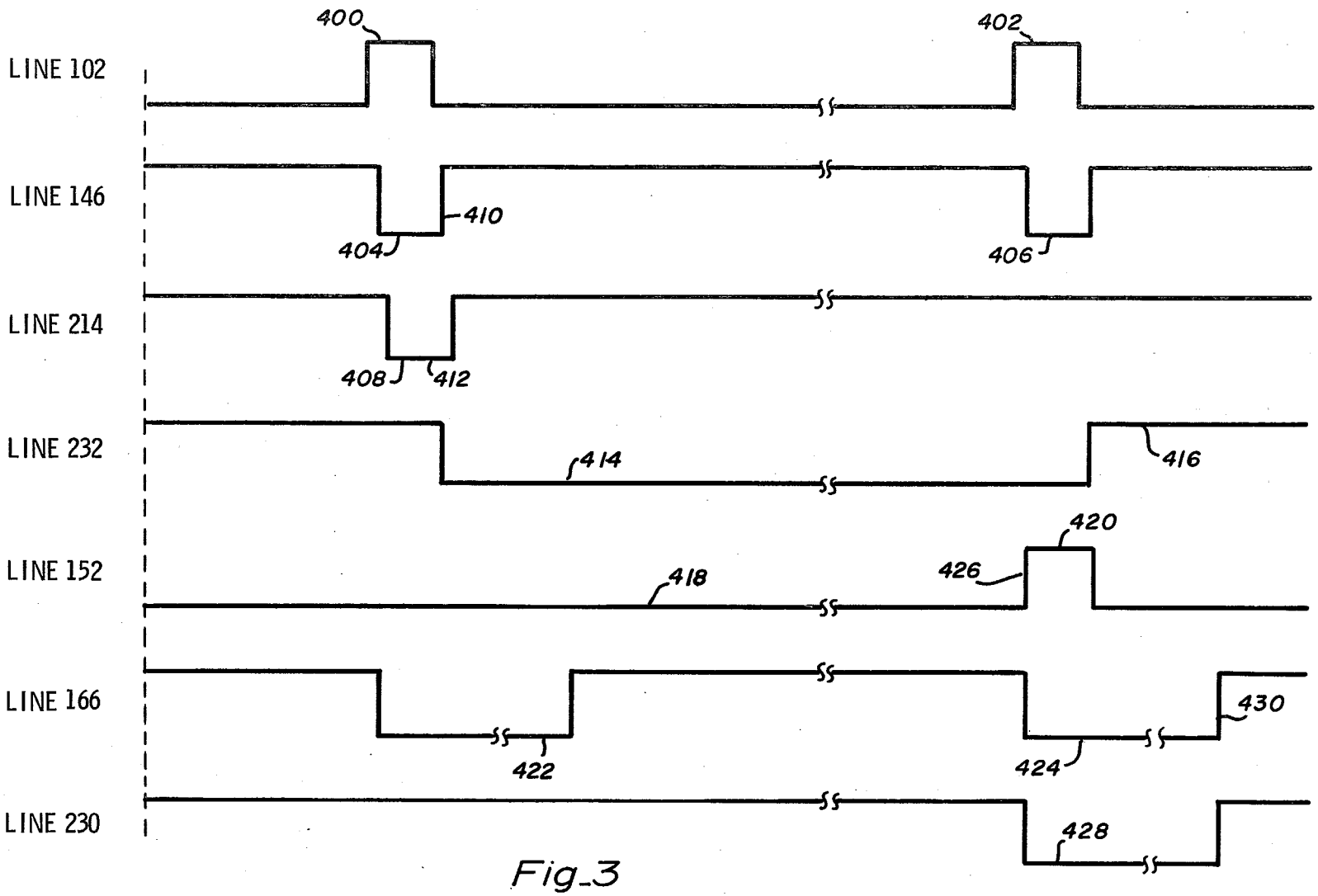
FIG. 3 is a timing diagram of the detector/transmitter illustrated in FIG. 2.

In order to explain the operation of smoke detector/-transmitter 10, reference is also made to FIG. 3 of the drawing which is a timing diagram illustrating the operative states of the various components. Once every five to ten seconds capacitor 126 is charged by the current flowing from battery 110 and through resistor 128 to a potential sufficient to cause conduction of PUT 118. The conduction of PUT 118 develops a pulse of approximately 200-microsecond width on line 102, such as those illustrated at 400 and 402. Responsive to these pulses, transistor 120 generates inverted clocking pulses on line 146 as illustrated at 404 and 406. Powered by the pulses generated on line 102, IRED 20 emits infrared radiation. Should this radiation strike smoke particles at the intersection of the axes of IRED 20 and detector 22, a fraction of the radiation will be reflected so as to strike detector 22. Responsive to such reflected radiation, detector 22 generates a current on line 106 which causes amplifier 178 and transistor 182 to develop an inverted pulse on line 214 as illustrated at 408. Although the smoke may remain in the optical path of IRED 20, reflection of radiation will only occur while IRED 20 is emitting radiation, thus resulting in the inverted pulse-shaped wave form.

The trailing edge of the pulse developed on line 146 and illustrated at 410 clocks the signal developed on line 214 illustrated at 412 into gate 28 which, until clocked by the next pulse, generates a low signal level on line 232 as illustrated at 414. This low signal level causes driver 240 to connect line 112 to line 242 continuously actuating transmitter 32 to warn of the smoke.

Should the smoke particles have dissipated prior to the occurrence of the next clocking pulse on line 146, a high logic level potential will be generated on line 214 causing gate 28 to again generate a high logic level on line 232 as illustrated at 416, thus, automatically self-clearing the device.

During the pulse developed on line 102, transistor 122 does not provide a sink for current flowing through resistor 154. Current is now sunk, if at all, by transistor 220. When the battery voltage drops below the minimum level, such as at point 418, transistor 220 no longer provides a sink for current flowing through resistor 154. Thereafter, coincident with pulses such as pulse 402, developed on line 102, a high logic level pulse is developed on line 152 as illustrated at 420.

Capacitor 162 is charged by the pulses developed on line 102 turning transistor 124 on which develops pulses on line 166 such as those illustrated at 422 and 424. Because of the charge storage effect of capacitor 162, these pulses are much longer than those developed on line 102 and are thus not illustrated to scale.

The leading edge 426 of the pulse illustrated at 420 sets gate 26 which generates a low logic level on line 230 as illustrated at 428. Gate 26 generates the low logic level until reset by the low-to-high transition of the next clock pulse developed on line 166 as illustrated at 430. In response to the high logic level pulses, driver 240 pulses transmitter 32 once for approximately 120 milliseconds each five to ten seconds to warn of the low battery voltage.

Figure 4:
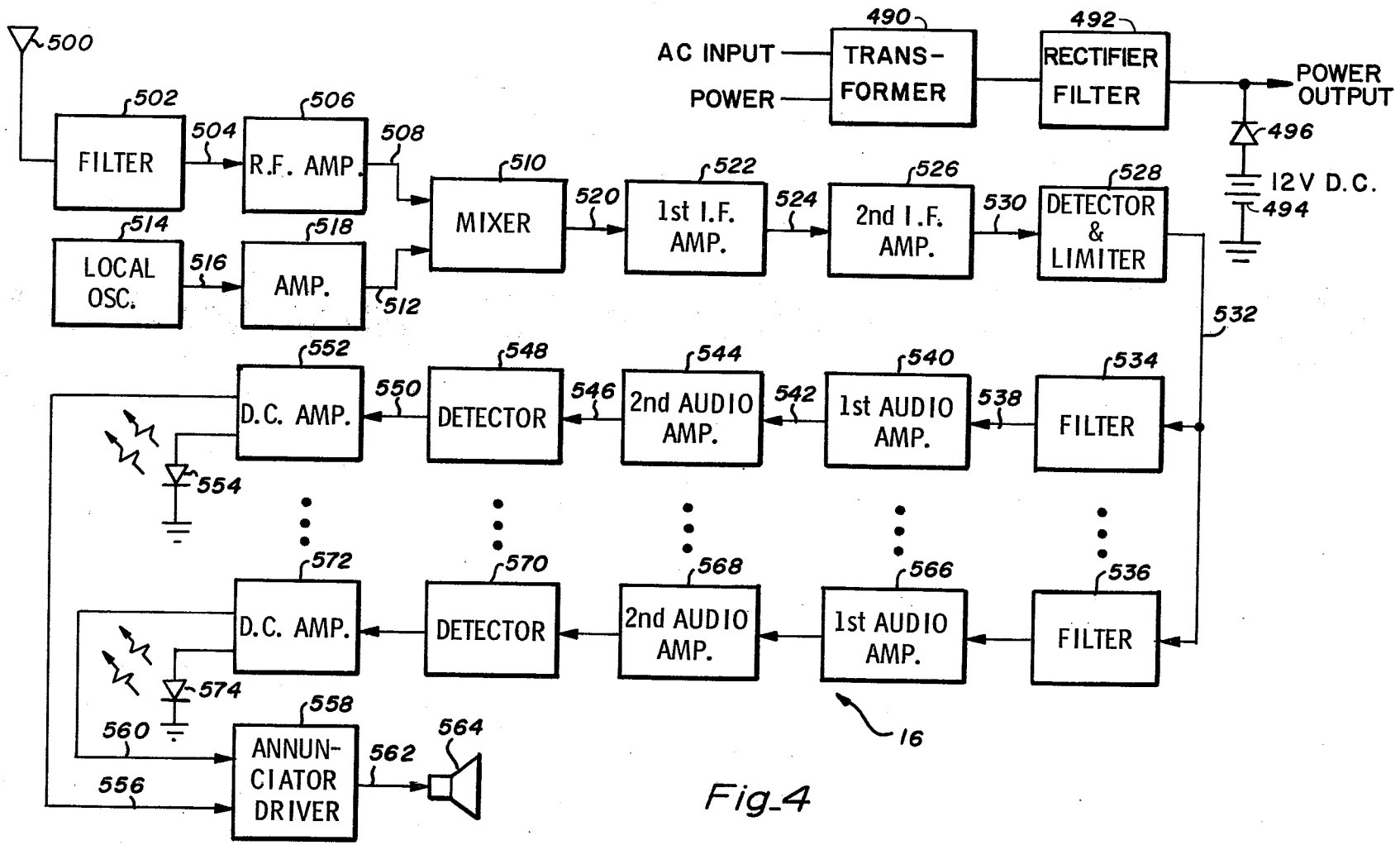
FIG. 4 is a block diagram further illustrating the components of the receiver/annunciator shown in FIG. 1.

A block diagram generally illustrating the principal components of receiver/annunciator unit 16 is shown in FIG. 4.

Power for the receiver, detector, and annunciator is preferably provided from the A.C. house supply through transformer 490 and rectifier/filter 492 with a 12 volt DC battery 494 providing a back-up voltage supply through diode 496 in case of power outage. Since the house supply is normally utilized, the back-up battery 494 can be relatively inexpensive with limited power capability.

Signals transmitted by the various smoke detector/-transmitter units are received by an antenna 500, which in the preferred embodiment is a quarter wave monopole having a length of approximately 12 inches for a receiver frequency of 240 megahertz.

The received signals are filtered by a two-pole band pass filter 502. Filter 502 attenuates the out-of-band signals to prevent them from overdriving the following stages.

The filtered signals are connected by a line 504 to an RF amplifier 506. The amplifier includes a low-noise field-effect transistor and a second two-pole band pass filter to provide an improved noise figure and greater selectivity.

Amplifier 506 is connected by a line 508 to a first input of a mixer 510. Mixer 510 also receives on a line 512, a local oscillator signal which is generated in oscillator 514. Oscillator 514 includes a field-effect transistor connected in a Colpitts configuration and tuned to a frequency 10.7 megahertz different from that of the smoke detector/transmitter units. The local oscillator signal which is generated on line 516 is amplified by an amplifier 518 to provide isolation between local oscillator 514 and mixer 510 and is then coupled to mixer 510 by line 512.

Mixer 510 uses a dual-gate field-effect transistor to simultaneously provide the mixing action and signal amplification. A single-pole band pass filter in the drain circuit of mixer 510 rejects all but the 10.7 megahertz signal which is developed on a line 520.

The intermediate frequency (IF) signal is amplified by a first IF amplifier 522, which generates an amplified and filtered IF signal on a line 524. IF amplifier 522 uses an integrated circuit with an external one-pole band pass filter.

A similar second IF amplifier 526 provides further amplification to drive a detector/limiter 528 via a line 530.

Detector/limitor 528 provides additional amplification to the IF frequency signals. The additional amplification is necessary to insure that such signals are clipped, or limited. Detector/limitor 528 is configured to function as a quadrature type FM detector to recover the FM modulation present on the IF signal.

The detected signal, which is developed on a line 532 by detector/limitor, is connected to a plurality of band pass filters represented by filters 534 and 536. Usually, at least one such filter is included for each smoke detector/transmitter unit which is to be operated with receiver/annunciator unit 16. Each filter includes a two-pole band pass filter which, in the preferred embodiment, is tuned to a different frequency in the vicinity of 100 kilohertz. The frequencies are selected to correspond to the frequencies at which the modulation oscillators in the smoke detector/transmitter units operate.

Signals passed by filter 534 are coupled by a line 538 to a first audio amplifier 540. The amplifier uses an operational amplifier to develop on a line 542 a signal which is amplified 40 decibels with respect to the signal on line 538.

The amplified signal is further amplified by a second audio amplifier 544 and coupled by a line 546 to a detector 548. Detector 548 includes two diodes and a capacitor connected in a doubler configuration to generate a rectified signal on a line 550 coincident with an AC signal being developed on line 546. A DC amplifier 552 amplifies the rectified signal which drives an LED 554 to provide a visual indication of the identity of the smoke detector/transmitter from which the signal originated.

DC amplifier 552 develops a second DC signal on a line 556, which is amplified by an annunciator driver 558. Driver 558 also amplifies DC signals on any of a plurality of input lines represented by line 556 and a line 560 to develop an actuator driving signal on a line 562 which actuates an annunciator or buzzer 564.

A plurality of additional audio frequency circuits similar to those just discussed and including filter 536, a first audio amplifier 566, a second audio amplifier 568, a detector 570, and a DC amplifier 572 are connected between line 532 and annunciator driver 558. Each of the filters are tuned to the modulation frequency corresponding to their assigned smoke detector/transmitter unit to develop an annunciator driver input signal in response to a signal transmitted by their respective detector/transmitter unit.

Each DC amplifier also operates an LED such as LED 574, driven by amplifier 572 to provide a visual indication identifying the detector/transmitter unit from which the signal originated.

It is contemplated that after having read the preceeding disclosure certain alterations and modifications of the present invention will no doubt become apparent to those skilled in the art. It is therefore intended that the following claims be interpreted to cover all such alterations and modifications as follow within the true spirit and scope of the invention.

What is claimed is:

1. A detector/transmitter unit for a wireless smoke detector system comprising at least one detector/transmitter unit and a receiver/annunciator unit for producing alarm signals in response to actuating signals transmitted by radio frequency waves from said at least one detector/transmitter unit, said detector/transmitter unit comprising:

pulse means for repetitively generating a clock signal;

an infrared source for repetitively generating a beam of infrared radiation responsive to said clock signal and substantially coincident in time with said clock signal;

a photodetector having a collection axis angularly intersecting said beam for detecting infrared radiation reflected from smoke particles encountered by said beam and for developing an infrared detection signal whenever smoke particles are detected;

low battery voltage detecting means for monitoring the voltage across a power source for the detector/transmitter unit and for developing a low battery signal whenever said voltage falls below a predetermined level; and transmitter means (1) for generating a first actuating signal for said receiver/annunciator unit in response to both said clock signal and said low battery signal, and (2) for generating a second actuating signal for said receiver/annunciator in response to both said clock signal and said detection signal.

2. A detector/transmitter unit according to claim 1 wherein said collection axis angularly intersects said beam at an angle in the range of 115° to 135°.

3. A detector/transmitter unit according to claim 2 wherein said transmitter means includes:

first gate means responsive to said clock signal and said low battery signal for generating a first gate signal for a first time period following the occurrence of said clock signal;

amplifier means for amplifying said detection signal to produce an amplified signal;

second gate means responsive to said clock signal and said amplified signal for generating a second gate signal for a second time period following the occurrence of both said clock signal and said amplified signal; and a radio frequency oscillator (1) responsive to said first gate signal for generating said first actuating signal substantially coincident in time with said first gate signal and (2) responsive to said second gate signal for generating said second actuating signal substantially coincident in time with said second gate signal.

4. A detector/transmitter unit according to claim 3 wherein:

said first gate means is a first flip-flop device having a clock input for receiving said clock signal, a set input for receiving said low battery signal, and an output for generating said first gate signal; and said second gate means is a second flip-flop device having a clock input for receiving said clock signal, a data input for receiving said amplified signal, and an output for generating said second gate signal.

5. A detector/transmitter unit according to claim 3 wherein said transmitter means further includes a radio frequency amplifier for amplifying said first and second actuating signals to extend the range of said detector/-transmitter unit.

6. A detector/transmitter unit according to claim 3 wherein said first time period is less than the time between successive clock signals generated by said pulse means and wherein said second time period is substantially equal to the time between successive clock signals generated by said pulse means, whereby the transmission period for said first actuating signal is equal to only a portion of the time between successive clock signals and whereby the transmission period for said second actuating signal is substantially equal to the entire time between successive clock signals.

7. A receiver/annunciator unit for a wireless smoke detector system according to claim 6 wherein said receiver/annunciator unit is activated to produce alarm signals only for time periods substantially equal to said transmission periods.

8. A detector/transmitter unit according to claim 2 wherein said transmitter means includes modulator means for distinctly modulating said first and second actuating signals to differentiate them from actuating signals developed by other detector/transmitter units.

9. A detector/transmitter unit according to claim 8 wherein said modulator means frequency modulates said first and second actuating signals at a superaudio rate.

* * * * *